US007867389B2

(12) United States Patent
Hui

(10) Patent No.: US 7,867,389 B2
(45) Date of Patent: Jan. 11, 2011

(54) POOL CLEANING VEHICLE HAVING AN ADVANCED DRAIN SYSTEM

(75) Inventor: Wing-kin Hui, Hong Kong (HK)

(73) Assignee: Pool Technology, Hong Kong (HK)

( * ) Notice: Subject to any disclaimer, the term of this patent is extended or adjusted under 35 U.S.C. 154(b) by 94 days.

(21) Appl. No.: 12/116,047

(22) Filed: May 6, 2008

(65) Prior Publication Data

US 2009/0277821 A1 Nov. 12, 2009

(51) Int. Cl.
*E04H 4/16* (2006.01)

(52) U.S. Cl. ..... 210/167.16; 210/416.2; 15/1.7

(58) Field of Classification Search ..... 210/167.1, 210/167.16, 167.17, 416.1, 416.2; 15/1.7
See application file for complete search history.

(56) References Cited

U.S. PATENT DOCUMENTS 3,886,616 A * 6/1975 Hayes ..... 15/1.7
5,135,647 A * 8/1992 Childers ..... 210/136
6,299,699 B1 * 10/2001 Porat et al. ..... 134/6
6,502,269 B1 * 1/2003 Balchan et al. ..... 15/1.7
6,842,931 B2 * 1/2005 Porat et al. ..... 15/1.7
7,178,188 B1 * 2/2007 Jaakola ..... 15/1.7

FOREIGN PATENT DOCUMENTS

DE 2808785 * 9/1978

* cited by examiner

*Primary Examiner*—Fred Prince
(74) *Attorney, Agent, or Firm*—Peninsula IP Group; Douglas Chaikin

(57) ABSTRACT

Disclosed herein is a pool cleaning an electric pool cleaning vehicle having a drive assembly and including an advanced system for draining water from the vehicle as the vehicle is removed from a pool of water. The vehicle includes a housing defining a body shell and the body shell having an interior cavity and an electrical power cord to supply power to the vehicle having a connection point on the vehicle. A filtering system is located within the body cavity. The vehicle includes a drain door assembly and the drain door assembly has an inlet connected to the filtering system. A handle is located adjacent the electrical cord connection point, sized and shaped to easily lift the vehicle filled with water out of a pool and the drain door assembly being on an opposed portion of the vehicle from the handle.

9 Claims, 2 Drawing Sheets

POOL CLEANING VEHICLE HAVING AN ADVANCED DRAIN SYSTEM

FIELD OF THE INVENTION

This invention generally relates to the field of motor driven pool cleaning vehicle. More particularly, this invention relates to the structure for draining the pool cleaning vehicle as it is lifted from a pool of water.

BACKGROUND OF THE INVENTION

A typical pool cleaning vehicle is powered by an electrical cord. The electrical cord connects to an electrical motor through the vehicle's body shell. The vehicle is designed to clean pool water by motoring along the floor bottom and sides. The electrical cord also provides electrical power to a motor that creates a vacuum within the body shell cavity for scooping up dirt and debris. The body shell includes an intake which is connected to the vacuum and through which the water flows. The body shell includes a filter bag in the interior which traps dirt and debris after being vacuumed into the interior.

As will be appreciated as the pool cleaning vehicle travels around the pool, it is filled with water. Depending upon the size of the vehicle, the water filling the vehicle may be quite heavy. As is well known, in order to clean the filter bag, the vehicle must be lifted out of water while still filled with water. Typically a handle is provided on the vehicle in order to accomplish this. However, the positioning of the handle has not in the past been considered critical. And, very often, only the very fit are strong enough to lift the water filled vehicle out of the water.

Additionally, when the water filled vehicle is pulled from the water, all of the filtered water simply drains out of the vehicle. In the past, little or no attention has been given to the drained water. This means that dirt and debris not completely trapped by the filter bag simply drains back into the pool needing once again to be cleaned.

What is needed is a pool cleaning vehicle having a handle which works in conjunction with the drainage system of the vehicle. What is also needed is a drain system that allows the water filled vehicle to be pulled from the pool without pouring the dirt and debris back into the pool.

SUMMARY OF THE INVENTION

The structure, in accordance with the present invention, is a pool cleaning vehicle including an advanced drainage system. The drainage system of the invention works to allow the user to easily remove the water filled vehicle from pool and to provide structure so that upon removal of the water filled vehicle form the pool dirt and debris remain in the body cavity of the pool cleaning vehicle instead of being drained back into the pool. The pool cleaning vehicle includes a handle and a drainage door, opposed to one another, so that they work cooperatively in quickly drainage water from the vehicle, thus enabling even a person of moderate fitness to lift the pool cleaning vehicle from the pool.

Additionally, the drainage system of the instant invention includes a screen which keeps the dirt and debris in the body cavity and the filter bag, while allowing water within the body cavity to be drained.

Thus, it is an object of this invention is to provide an pool cleaning vehicle having an advanced drainage system which allows the user to quickly drain water from the vehicle upon lifting the vehicle out of the water.

It is an additional object of this invention to provide such a pool cleaning vehicle wherein the drainage assembly is positioned opposed to the handle to facilitate such quick drainage.

It is an additional object of this invention to provide such a pool cleaning vehicle wherein the drainage assembly includes a mesh screen for trapping dirt and debris in the body cavity filter bag while the water filled vehicle is being drained.

In accordance with the objects set forth above and as will be described and as will become herein, the pool cleaning vehicle having the advanced drainage system in accordance with this invention, comprises:

the vehicle including a housing defining a body shell and the body shell having an interior cavity, a top, sides and a front and back and an electrical power cord to supply power to the vehicle having a connection point on the vehicle;

within the body cavity is located a filtering system and the vehicle including drain door assembly and the drain door assembly having an inlet connected to the filtering system;

a handle located adjacent the electrical cord connection point, sized and shaped to easily lift the vehicle filled with water out of a pool; and the drain door assembly being on an opposed portion of the vehicle.

In another exemplary embodiment of the instant invention, when the vehicle is pulled out of the pool by the handle, the handle is on top and the drain door is on the bottom, allowing water to drain completely from the vehicle cavity in very rapid manner.

In another exemplary embodiment of the instant invention, the drain assembly includes a mesh screen as part of the drainage assembly that traps debris and dirt in the body cavity while allowing the water therein to be drained.

It is an advantage of this invention to provide a pool cleaning vehicle, which, even when filled with water, is capable of being lifted from a pool by a person of ordinary fitness.

It is an advantage of this invention to provide a pool cleaning vehicle having an advanced drainage system, which keeps dirt and debris within the body cavity filter system, even while lifting the water filled pool cleaning vehicle and draining water therefrom.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
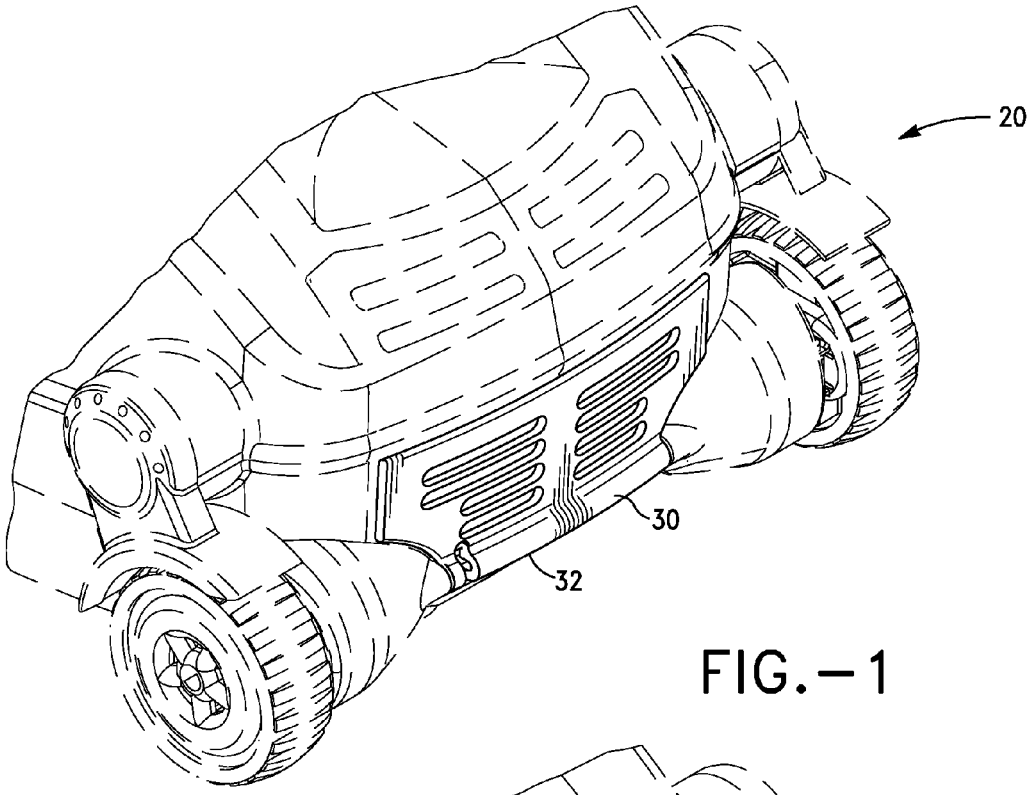
FIG. 1 is a prospective view of the pool cleaning vehicle having the advanced drainage system in accordance with the invention, with the drainage system in a closed position.
Figure 2:
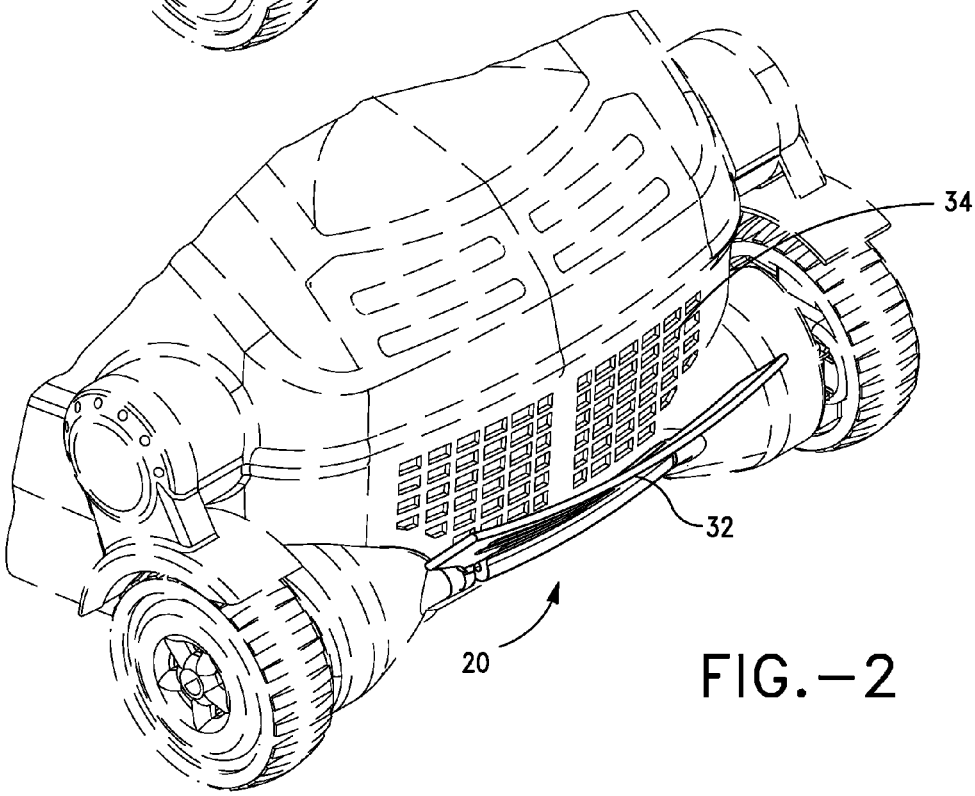
FIG. 2 is a prospective view of the pool cleaning vehicle having the advanced drainage system in accordance with the invention, with the drainage system in an open position.

With particular reference to FIG. 1-4, there is shown an exemplary embodiment of the pool cleaning vehicle having the advanced drainage system in accordance with the present invention generally denoted by the numeral 20. The vehicle 20 includes a drainage assembly 30. The drainage assembly 30 is located in the lower front portion of the vehicle 20 between the drive wheels or rollers.

The drainage assembly 30 includes a drainage door 32 and a mesh screen 34. The drainage door 32 has a first closed position illustrated in FIG. 1 and a second open position, illustrated in the remaining figures. In the first position, the door 32 is closed and provides a seal for the drainage assembly 30. This insures that water is kept within the body cavity while the vehicle 20 is immersed in the pool.

As the vehicle 20 travels around the pool, cleaning dirt and debris, water is sucked into the pool cleaning vehicle through inlets (not shown). The water passes through a filter bag within the vehicle body cavity and is trapped therein. Some of the dirt and debris cling to the fabric of the filter bag. However, other dirt and debris merely float around the water within the confines of the body cavity and the filter bag.

Figure 3:
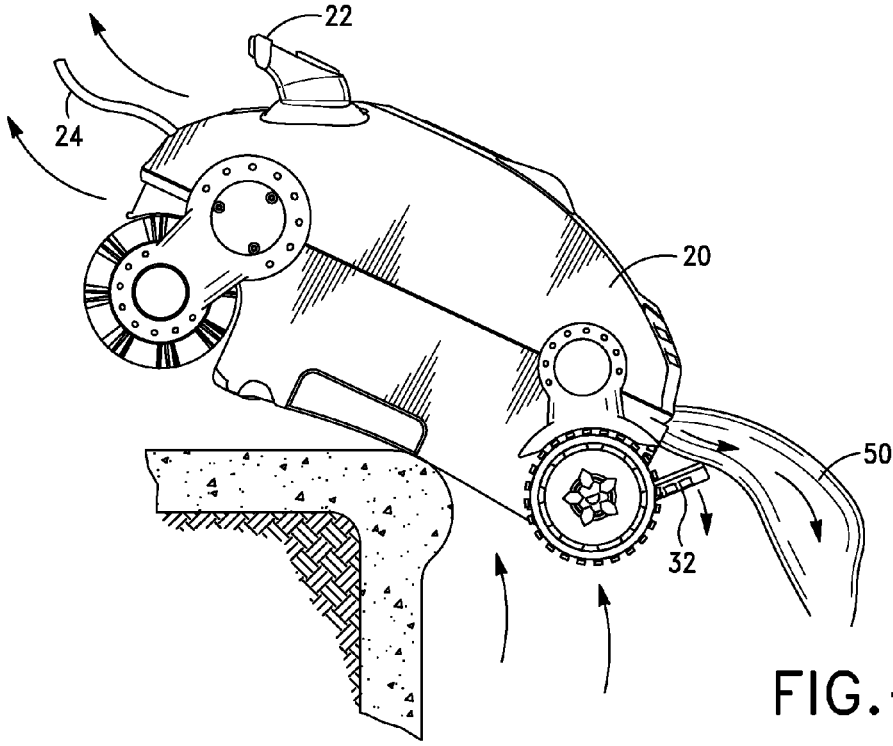
FIG. 3 is a side view of a water filled pool cleaning vehicle having the advanced drainage system in accordance with the invention being lifted from the pool.

As shown clearly in FIG. 3, the pool cleaning vehicle includes a handle 22. The pool cleaning vehicle 20 is lifted out of pool by the handle 22. As the vehicle 20 is pulled from the pool, water 50 flows out of the vehicle 20. As illustrated, the drain door 32 fully opens allowing the maximum volume of water possible to flow from the vehicle 20 as quickly as possible.

Also, as illustrated in FIG. 3, the drainage water must flow through the mesh screen 34 before exiting the vehicle 20. The mesh screen 34 traps the dirt and debris suspended in the interior of the body and filter bag while the filtered water drains from the vehicle 20.

Figure 4:
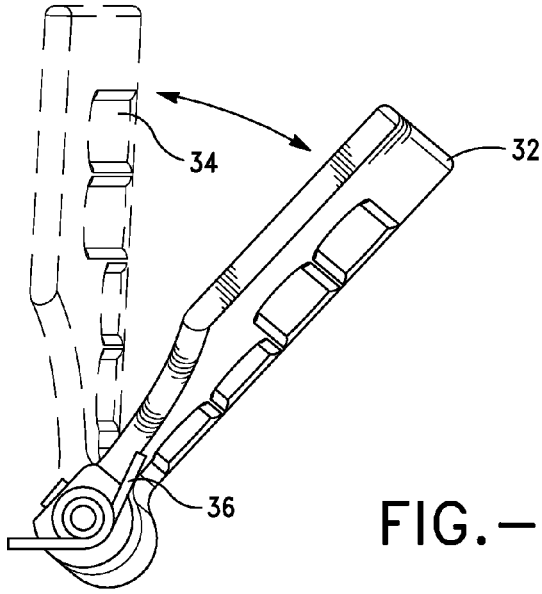
FIG. 4 is an enlarged side view of drainage door assembly in accordance with the invention.

FIG. 4 illustrates the construction of the drainage door assembly 30 and operation. The drainage door assembly 30. The assembly includes the door 32 and the mesh screen 34 and a spring 36 normally urging the door to the closed position shown in FIG. 1. Upon the pool cleaning vehicle 20 being lifted from the pool the door swings into the fully opened position. It will be noted that unlike some pool cleaning vehicles, the drive wheels or rollers do not interfere with the ability of the door to fully open.

The door is made from a rigid material. In an exemplary embodiment, the door 32 is made from a rigid plastic. In another exemplary embodiment the door 32 is made from an engineering plastic.

As shown best in FIG. 3, the handle 22 and the drainage door are opposed to one another. In fact, in an exemplary embodiment the two elements of the invention are 180 degrees from one another. The handle 22 being located adjacent the electrical power cord 24 and towards the top of the vehicle. The drainage door 32 being on the opposite side from the power cord 24 and toward the bottom of the vehicle 20.

With the positioning of the handle 22 and drainage door 32, as the water filled pool cleaning vehicle 20 is lifted from the pool, maximum flow of water through the mesh screen 34 results. Thus, the water filled vehicle 20 drains as quickly as possible upon being lifted from the water.

As will be appreciated, the water filled vehicle 20 maintains a certain buoyancy depending upon the manufacturer's design as it travels around the pool. As a result of the buoyancy of the vehicle 20 in the water, it is relatively easy to begin the process of lifting the vehicle 20 out of the water. However, once the vehicle 20 breaks the plane of the water, the full weight of the water is brought to bear upon the vehicle. Thus, unless the water exits the vehicle 20 almost immediately, only the fittest and strongest among us are able to lift the water filled vehicle 20 out of the pool. The instant invention provides that the relationship between the handle 22 and drainage door 32 encourage the drainage water flow to be almost immediate. Thus, even the average fit person can still lift the water filled vehicle from the pool.

While the foregoing detailed description has described several embodiments of the pool cleaning vehicle with the advanced drainage system in accordance with this invention, it is to be understood that the above description is illustrative only and not limiting of the disclosed invention. Particularly, there are variety of different positional relationships between the handle and drainage door that would product a similar effect. All of these positions, although not described are fully within the spirit and scope of the invention. It also will be appreciated that there are various modifications to the drainage door itself could be made to work within the spirit and scope of the invention herein Thus, the invention is to be limited only by the claims as set forth below.

What is claimed is:

1. An electric pool cleaning vehicle having a drive assembly and including an advanced system for draining water from the vehicle as the vehicle is removed from a pool of water, the vehicle comprising:

the vehicle including a housing defining a body shell and the body shell having an interior cavity, a top, sides and a front and back and an electrical power cord to supply power to the vehicle having a connection point on the vehicle;

within the body cavity is located a filtering system and the vehicle including drain door assembly and the drain door assembly having an inlet connected to the filtering system, the drain assembly includes a mesh screen that keeps debris and dirt in the body cavity while allowing water to be drained from the pool cleaning vehicle;

a handle located on top of the vehicle and adjacent the electrical cord connection point, sized and shaped to easily lift the vehicle filled with water out of a pool; and the drain door assembly being on the bottom defining an opposed portion of the vehicle from the handle.

2. The pool cleaning vehicle of claim 1, wherein the dirt and debris is trapped in the filtering system.

3. The pool cleaning vehicle of claim 2, wherein the drain door assembly includes a drain door made from a rigid material.

4. The pool cleaning vehicle of claim 2, wherein the drain door assembly includes a drain door made from engineering plastics.

5. The pool cleaning vehicle of claim 2, wherein the drain door is normally urged to a closed position.

6. The pool cleaning vehicle of claim 5, wherein the drain door is spring loaded into a normally closed position.

7. The pool cleaning vehicle of claim 2, wherein the drain door is positioned so that it fully opens during draining.

8. The pool cleaning vehicle of claim 7, wherein the drain door is positioned so that it fully opens during draining and the drive assembly does not interfere with the opening of the drain door.

9. The pool cleaning vehicle of claim 1, wherein the electrical power cord connection point is located toward the top of the body shell and wherein the handle is located adjacent the connection point, and more toward the top of the vehicle than the connection point and the drain door assembly located approximately 180 degrees from the handle.

* * * * *